US011965685B2

(12) United States Patent
Yang et al.

(10) Patent No.: US 11,965,685 B2
(45) Date of Patent: Apr. 23, 2024

(54) MAGNETIC BEARING COMPRESSOR, AIR CONDITIONER, AND PROTECTIVE AIR GAP VALUE SETTING METHOD

(71) Applicants: HEFEI MIDEA HEATING & VENTILATING EQUIPMENT CO., LTD., Hefei (CN); GD MIDEA HEATING & VENTILATING EQUIPMENT CO., LTD., Foshan (CN)

(72) Inventors: Bin Yang, Hefei (CN); Fengshuang Wang, Hefei (CN)

(73) Assignees: HEFEI MIDEA HEATING & VENTILATING EQUIPMENT CO., LTD., Hefei (CN); GD MIDEA HEATING & VENTILATING EQUIPMENT CO., LTD. Foshan (CN), Foshan (CN)

( * ) Notice: Subject to any disclaimer, the term of this patent is extended or adjusted under 35 U.S.C. 154(b) by 538 days.

(21) Appl. No.: 17/418,834

(22) PCT Filed: Jul. 8, 2019

(86) PCT No.: PCT/CN2019/095064
§ 371 (c)(1),
(2) Date: Jun. 27, 2021

(87) PCT Pub. No.: WO2020/134020
PCT Pub. Date: Jul. 2, 2020

(65) Prior Publication Data

US 2022/0074638 A1 Mar. 10, 2022

(30) Foreign Application Priority Data

Dec. 29, 2018 (CN) ..... 201811641358.7

(51) Int. Cl.
*F04D 29/048* (2006.01)
*F04D 29/058* (2006.01)
(Continued)

(52) U.S. Cl.
CPC ..... *F25B 49/022* (2013.01); *F24F 11/30* (2018.01); *F24F 11/64* (2018.01)

(58) Field of Classification Search
CPC ..... F04D 29/048; F04D 27/001; F05D 2270/821; H02K 7/09; H02K 2213/06; F25B 49/022; F24F 11/64; F24F 11/30
(Continued)

(56) References Cited

U.S. PATENT DOCUMENTS 7,843,098 B2 * 11/2010 Coenen ..... F16C 39/02 310/90.5
8,362,731 B2 * 1/2013 Smith ..... H02K 7/088 318/400.41
(Continued)

FOREIGN PATENT DOCUMENTS

CN 101408169 A 4/2009
CN 101881302 A 11/2010
(Continued)

OTHER PUBLICATIONS

OA for CN application 201811641358.7.
ISR for PCT application PCT/CN2019/095064.

*Primary Examiner* — Burton S Mullins

(57) ABSTRACT

Provided are a magnetic bearing compressor, an air conditioner and a protective air gap value setting method. The magnetic bearing compressor includes: a rotor, a magnetic bearing, a sensor, and a control device. The magnetic bearing is sleeved on the rotor; the sensor is arranged on the magnetic bearing and is configured to detect a distance value between the rotor and the sensor on a preset plane; the control device is configured to receive the distance value and
(Continued)

determine the minimum distance value and the maximum distance value between the rotor and the magnetic bearing according to the distance value, and obtain an absolute value of a difference of the maximum distance value and the minimum distance value; and the control device obtains a protective air gap value according to the absolute value and a preset protection coefficient when the absolute value is less than or equal to a preset air gap value.

16 Claims, 9 Drawing Sheets

(51) Int. Cl.

| | |
|---|---|
| ***F24F 11/30*** | (2018.01) |
| ***F24F 11/64*** | (2018.01) |
| ***F25B 49/02*** | (2006.01) |
| ***H02K 7/09*** | (2006.01) |

(58) Field of Classification Search
USPC ..... 310/90.5
See application file for complete search history.

(56) References Cited

U.S. PATENT DOCUMENTS

| | | | | |
|---|---|---|---|---|
| 10,921,108 | B2 * | 2/2021 | Denk | F16C 32/0453 |
| 2004/0011149 | A1 * | 1/2004 | Carroll | G01D 5/3473<br>702/151 |
| 2014/0145534 | A1 * | 5/2014 | Kammer | F16C 32/0451<br>310/90.5 |
| 2014/0252899 | A1 * | 9/2014 | Looser | G01D 5/202<br>310/90.5 |
| 2019/0219482 | A1 * | 7/2019 | Köhler | F16C 32/0446 |

FOREIGN PATENT DOCUMENTS

| | | | |
|---|---|---|---|
| CN | 101886668 | A | 11/2010 |
| CN | 102472685 | A | 5/2012 |
| CN | 103196672 | A | 7/2013 |
| CN | 104166345 | A | 11/2014 |
| CN | 105298823 | A | 2/2016 |
| JP | 2009287573 | A | 12/2009 |
| JP | 2016169773 | A | 9/2016 |

* cited by examiner

MAGNETIC BEARING COMPRESSOR, AIR CONDITIONER, AND PROTECTIVE AIR GAP VALUE SETTING METHOD

CROSS-REFERENCES TO RELATED APPLICATIONS

The present disclosure is a national phase application of International Application No. PCT/CN2019/095064, filed on Jul. 8, 2019, which claims priority of Chinese Patent Application No. 201811641358.7, filed on Dec. 29, 2018, the entireties of which are herein incorporated by reference.

FIELD

This application relates to the field of magnetic bearing compressor, and more particularly, to a magnetic bearing compressor, an air conditioner, a protective air gap value setting method for a magnetic bearing compressor, and a computer-readable storage medium.

BACKGROUND

Generally speaking, a magnetic bearing compressor is widely applied to an air conditioning system due to the characteristics such as low noise, low maintenance cost, high operating efficiency, lightweight body and small starting current. The magnetic bearing compressor includes members such as a rotor, a stator, a magnetic bearing, a position sensor, the other magnetic bearing, and a bearing controller, and the internal diameter of the magnetic bearing is less than that of the other magnetic bearing, which plays a role in avoiding direct contact between the rotor and the magnetic bearing, to avoid the situations such as bearing wear and coil short. A gap between the rotor and the magnetic bearing is a moving air gap, a protective air gap is a value set in bearing control and used for triggering displacement protection for bearing control, and the moving air gap is generally adopted as the protective air gap for corresponding bearing protection during bearing control.

However, if the moving air gap is adopted as the designed maximum air gap, since an actual moving air gap of the rotor is smaller than a designed moving air gap during actual bearing control, the situation that the rotor is in contact with the magnetic bearing may be caused, and then, the problems, for example, the rotor is seriously worn, the service life of the compressor is shortened, the bearing is damaged due to bearing overload caused by untimely protection, the bearing controller is even damaged, and the difficulty in controlling the bearing is increased, are caused.

Therefore, some embodiment, by which a protective air gap can be accurately set, and when the displacement of the rotor is overlarge, control protection can be performed in advance to prevent the magnetic bearing compressor from being damaged, has been highly desired at present.

SUMMARY

The purpose of the present disclosure is to at least solve one of problems existing in the prior art or related art.

For this purpose, embodiments of the present disclosure provide a magnetic bearing compressor.

One embodiment of the present disclosure provides an air conditioner.

Another embodiment of the present disclosure provides a protective air gap value setting method for a magnetic bearing compressor.

In yet another embodiment of the present disclosure provides a computer-readable storage medium.

In view of this, embodiments of the present disclosure provide a magnetic bearing compressor including: a rotor, a magnetic bearing, a sensor, and a control device; the magnetic bearing is sleeved on the rotor; the sensor is arranged on the magnetic bearing and is configured to detect a distance value between the rotor and the sensor on a preset plane; and the control device is configured to receive the distance value and determine the minimum distance value and the maximum distance value between the rotor and the magnetic bearing according to the distance value, obtain an absolute value of a difference of the maximum distance value and the minimum distance value, and obtain a protective air gap value according to the absolute value and a preset protection coefficient when the absolute value is less than or equal to a preset air gap value.

In some embodiments, the magnetic bearing compressor includes the rotor, the magnetic bearing, the sensor, and the control device. The sensor detects the distance value between the rotor and the sensor on the preset plane and transmits the distance value to the control device. After receiving the distance value, detected by the sensor, the control device determines the minimum distance value and the maximum distance value between the rotor and the magnetic bearing, and calculates the absolute value of the difference of the maximum distance value and the minimum distance value, that is, an average distance value. Further, the preset air gap value is acquired, the calculated absolute value is compared with the preset air gap value, and the protective air gap value is obtained according to the absolute value and the preset protection coefficient when the absolute value is less than the preset air gap value. By applying some embodiments provided by the present disclosure, an appropriate protective air gap can be more accurately obtained, the situation that the rotor comes into collision with the magnetic bearing during actual operation due to the fact that a designed moving air gap is directly used as the protective air gap can be avoided, the magnetic bearing and the rotor can be effectively protected in advance, the accuracy for bearing protection can be improved, the response time of bearing control protection under an extreme condition can be shortened, the wear degrees of the rotor and the magnetic bearing can be lowered, and then, the service life of a complete machine can be prolonged.

In one embodiment, the protective air gap is firstly calibrated before the magnetic bearing compressor leaves factory. Firstly, the rotor is controlled to move in the magnetic bearing, and the maximum distance value and the minimum distance value between the rotor and the magnetic bearing, detected by the sensor arranged on the magnetic bearing, are continuously acquired. The sensor can be arranged on the side of the magnetic bearing, and a sensor probe is flush with the inner surface of the magnetic bearing, so that the distance between the rotor and the magnetic bearing is accurately acquired. The control device continuously records the distance value, acquired by the sensor, within a duration, and compares the maximum distance value and the minimum distance value in a recorded distance value set. Further, after the maximum distance value and the minimum distance value are determined, the absolute value of the difference of the maximum distance value and the minimum distance value, that is, an average moving air gap, is calculated; and when the calculated average moving air gap is less than or equal to the preset air gap value, that is, the calibrated moving air gap value, a product of the above-mentioned absolute value and the preset protection coefficient is further calculated and is set as the final protective air gap value.

In addition, the magnetic bearing compressor in the above-mentioned embodiment provided by the present disclosure can further have the following additional characteristics.

In the above-mentioned embodiment, the control device is further configured to set a product of the preset air gap value and the preset protection coefficient as the protective air gap value when the absolute value is greater than the preset air gap value.

In some embodiments, when the calculated absolute value is greater than the preset air gap value, it proves that the calibrated moving air gap is more conservative, at the moment, by taking a product of the calibrated moving air gap and the preset protection coefficient as the final protective air gap value, a protection action can be triggered more rapidly and timely, the response time of bearing control protection under an extreme condition can be shortened, the wear degrees of the rotor and the magnetic bearing can be lowered, and thus the service life of a complete machine can be prolonged.

In any one of the above-mentioned embodiments, the control device is further configured to: alternately send a first electric signal and a second electric signal to the magnetic bearing within a first preset duration; control, by the first electric signal, the magnetic bearing to attract the rotor in a first direction where the sensor is located until the rotor is in contact with the magnetic bearing; control, by the second electric signal, the magnetic bearing to attract the rotor in a direction opposite to the first direction until the rotor is in contact with the magnetic bearing; and acquire the distance value between the rotor and the sensor on the preset plane within the first preset duration to determine the minimum distance value and the maximum distance value.

In some embodiments, the first electric signal and the second electric signal are alternately sent to the magnetic bearing within the first preset duration, and the first electric signal is configured to control the magnetic bearing to attract the rotor in the first direction where the sensor is located until the rotor is in contact with the magnetic bearing, at the moment, the sensor can read the minimum distance value between the rotor and the sensor, that is, the minimum distance value between the rotor and the magnetic bearing; and the second electric signal is configured to control the magnetic bearing to attract the rotor in the direction opposite to the first direction until the rotor is in contact with the magnetic bearing, at the moment, the sensor can read the maximum distance value between the rotor and the sensor, that is, the maximum distance value between the rotor and the magnetic bearing.

In any one of the above-mentioned embodiments, further, the magnetic bearing includes a first magnetic bearing and a second magnetic bearing, and the sensor includes a first sensor and a second sensor; and the first magnetic bearing is provided with the first sensor, and the second magnetic bearing is provided with the second sensor.

In some embodiments, the magnetic bearing compressor is provided with two magnetic bearings, that is, the first magnetic bearing and the second magnetic bearing, in total and to realize stable operation of the magnetic bearing compressor. Meanwhile, the first magnetic bearing is provided with the first sensor configured to acquire a distance between the rotor and the first magnetic bearing, and the second magnetic bearing is provided with the second sensor configured to acquire a distance between the rotor and the second magnetic bearing. Values of the distances between the rotor and each of the two magnetic bearings are acquired by the first sensor and the second sensor respectively, so that actual moving air gap values of the rotor in the corresponding magnetic bearings are determined accurately.

In any one of the above-mentioned embodiments, further, the control device is further configured to: alternately send a third electric signal and a fourth electric signal to the first magnetic bearing within a second preset duration; control, by the third electric signal, the first magnetic bearing to attract the rotor in a second direction where the first sensor is located until the rotor is in contact with the first magnetic bearing; control, by the fourth electric signal, the first magnetic bearing to attract the rotor in a direction opposite to the second direction until the rotor is in contact with the first magnetic bearing; determine a first maximum value and a first minimum distance value between the rotor and the first sensor within the second preset duration; obtain an absolute value of a difference of the first maximum distance value and the first minimum distance value; and determine a first protective air gap value of the first magnetic bearing according to the absolute value.

In some embodiments, the third electric signal and the fourth electric signal are alternately sent to the first magnetic bearing within the second preset duration, and the third electric signal is configured to control the first magnetic bearing to attract the rotor in the second direction where the sensor is located until the rotor is in contact with the first magnetic bearing, at the moment, the first sensor can read the first minimum distance value between the rotor and the sensor, that is, the first minimum distance value between the rotor and the first magnetic bearing; and the fourth electric signal is configured to control the first magnetic bearing to attract the rotor in the direction opposite to the second direction until the rotor is in contact with the second magnetic bearing, at the moment, the first sensor can read the first maximum distance value between the rotor and the first sensor, that is, the first maximum distance value between the rotor and the first magnetic bearing. Then, the absolute value of the difference of the first maximum distance value and the first minimum distance value, that is, a first average moving air gap value of the rotor in the first magnetic bearing, is calculated; and when the calculated first average moving air gap value is less than or equal to the preset air gap value, that is, the calibrated moving air gap value, a product of the first average moving air gap value and the preset protection coefficient is calculated and is set as the final protective air gap value. If the first average moving air gap value, that is, the above-mentioned first absolute value, is greater than the preset air gap value, the product of the preset air gap value and the preset protection coefficient is used as the final protective air gap value.

In any one of the above-mentioned embodiments, further, the control device is further configured to: send a fifth electric signal to the second magnetic bearing while sending the third electric signal to the first magnetic bearing within the second preset duration; send a sixth electric signal to the second magnetic bearing while sending the fourth electric signal to the first magnetic bearing; control, by the third electric signal, the second magnetic bearing to attract the rotor in a third direction where the second sensor is located until the rotor is in contact with the second magnetic bearing; control, by the fourth electric signal, the second magnetic bearing to attract the rotor in a direction opposite to the third direction until the rotor is in contact with the second magnetic bearing; determine a second maximum distance value and a second minimum distance value between the rotor and the second sensor within the second preset duration; obtain a second absolute value of a difference of the second maximum distance value and the second minimum distance value; and determine a second protective air gap value of the second magnetic bearing according to the second absolute value; and the third direction is opposite to the second direction.

In some embodiments, within the second preset duration, the third electric signal is sent to the first magnetic bearing so that the first magnetic bearing attracts one end of the rotor in the second direction, and meanwhile, the fifth electric signal is sent to the second magnetic bearing so that the second magnetic bearing attracts the other end of the rotor in the third direction, that is the direction opposite to the second direction, at the moment, the two ends of the rotor respectively move in the opposite directions, that is, the rotor is "inclined" within the range of the magnetic bearings at the two ends until the two ends of the rotor are respectively in contact with the first magnetic bearing and the second magnetic bearing; and then, the fourth electric signal is sent to the first magnetic bearing so that the first magnetic bearing attracts one end of the rotor in the direction opposite to the second direction, and meanwhile, the sixth electric signal is sent to the second magnetic bearing so that the second magnetic bearing attracts the other end of the rotor in the direction opposite to the third direction, at the moment, the rotor is "inclined" in the opposite directions within the range of the magnetic bearings at the two ends. The two ends of the rotor are controlled to be respectively close to the first magnetic bearing and second magnetic bearing in the opposite directions, so that the movement range of the rotor changes, at the moment, the actual moving air gap of the rotor can be acquired more accurately, and a first protective air gap of the rotor on the first magnetic bearing and a second protective air gap of the rotor on the second magnetic bearing can be respectively obtained by calculation.

In any one of the above-mentioned embodiments, further, the preset plane is a plane where the sensor is located and which is perpendicular to an axis of the magnetic bearing; and the preset protection coefficient is a natural number greater than 0 and less than 1.

In some embodiments, the preset plane is a plane where the sensor is located and which is perpendicular to an axis of the magnetic bearing. In one embodiment, the axis of the magnetic bearing may be set as a z axis, a straight line where the sensor is located and which is perpendicular to the axis of the magnetic bearing is set as a y axis, and a plane where the z axis and the y axis are located is the preset plane. Further, a value of the preset protection coefficient K is within the range: $0<K<1$.

One embodiment of the present disclosure provides an air conditioner including the magnetic bearing compressor in any one of the above-mentioned embodiments, and therefore, the air conditioner has all the beneficial effects of the magnetic bearing compressor in any one of the above-mentioned embodiments.

One embodiment of the present disclosure provides a protective air gap value setting method for a magnetic bearing compressor, which is used for the magnetic bearing compressor in any one of the above-mentioned embodiments. The protective air gap value setting method includes: controlling a sensor to detect a distance value between a rotor and the sensor on a preset plane; receiving the distance value, and determining the minimum distance value and the maximum distance value between the rotor and the magnetic bearing according to the distance value; obtaining an absolute value of a difference of the maximum distance value and the minimum distance value; and obtaining a protective air gap value according to the absolute value and a preset protection coefficient when the absolute value is less than or equal to a preset air gap value.

In some embodiments, the magnetic bearing compressor includes a rotor, a magnetic bearing, a sensor, and a control device. The sensor detects the distance value between the rotor and the sensor on the preset plane and transmits the distance value to the control device. After receiving the value, detected by the sensor, of the distance, the control device determines the minimum distance value and the maximum distance value between the rotor and the magnetic bearing, and calculates the absolute value of the difference of the maximum distance value and the minimum distance value, that is, an average value of the distance. Further, the preset air gap value is acquired, the calculated absolute value is compared with the preset air gap value, and the protective air gap value is obtained according to the absolute value and the preset protection coefficient when the absolute value is less than the preset air gap value. By applying some embodiments provided by the present disclosure, an appropriate protective air gap can be more accurately obtained, the situation that the rotor comes into collision with the magnetic bearing during actual operation due to the fact that a designed moving air gap is directly used as the protective air gap can be avoided, the magnetic bearing and the rotor can be effectively protected in advance, the accuracy for bearing protection can be improved, the response time of bearing control protection under an extreme condition can be shortened, the wear degrees of the rotor and the magnetic bearing can be lowered, and then, the service life of a complete machine can be prolonged.

In the above-mentioned embodiment, further, the protective air gap value setting method further includes: setting a product of the preset air gap value and the preset protection coefficient as the protective air gap value when the absolute value is greater than the preset air gap value.

In some embodiments, when the calculated absolute value is greater than the preset air gap value, it proves that the calibrated moving air gap is more conservative, at the moment, by taking a product of the calibrated moving air gap and the preset protection coefficient as the final protective air gap value, a protection action can be triggered more rapidly and timely, the response time of bearing control protection under an extreme condition can be shortened, the wear degrees of the rotor and the magnetic bearing can be lowered, and then, the service life of a complete machine can be prolonged.

In any one of the above-mentioned embodiments, further, the step of determining the minimum distance value and the maximum distance value between the rotor and the magnetic bearing according to the distance value includes alternately sending a first electric signal and a second electric signal to the magnetic bearing within a first preset duration; controlling, by the first electric signal, the magnetic bearing to attract the rotor in a first direction where the sensor is located until the rotor is in contact with the magnetic bearing; controlling, by the second electric signal, the magnetic bearing to attract the rotor in a direction opposite to the first direction until the rotor is in contact with the magnetic bearing; and acquiring the distance value between the rotor and the sensor on the plane within the first preset duration and to determine the minimum distance value and the maximum distance value.

In some embodiments, the first electric signal and the second electric signal are alternately sent to the magnetic bearing within the first preset duration, and the first electric signal is configured to control the magnetic bearing to attract the rotor in the first direction where the sensor is located until the rotor is in contact with the magnetic bearing, at the moment, the sensor can read the minimum distance value between the rotor and the sensor, that is, the minimum distance value between the rotor and the magnetic bearing; and the second electric signal is configured to control the magnetic bearing to attract the rotor in the direction opposite to the first direction until the rotor is in contact with the magnetic bearing, at the moment, the sensor can read the maximum distance value between the rotor and the sensor, that is, the maximum distance value between the rotor and the magnetic bearing.

In any one of the above-mentioned embodiments, further, the magnetic bearing includes a first magnetic bearing and a second magnetic bearing, and the sensor includes a first sensor and a second sensor; and the first magnetic bearing is provided with the first sensor, and the second magnetic bearing is provided with the second sensor.

In some embodiments, the magnetic bearing compressor is provided with two magnetic bearings, that is, the first magnetic bearing and the second magnetic bearing, in total and to realize stable operation of the magnetic bearing compressor. Meanwhile, the first magnetic bearing is provided with the first sensor configured to acquire a distance between the rotor and the first magnetic bearing, and the second magnetic bearing is provided with the second sensor configured to acquire a distance between the rotor and the second magnetic bearing. Values of the distances between the rotor and each of the two magnetic bearings are acquired by the first sensor and the second sensor respectively, so that actual moving air gap values of the rotor in the corresponding magnetic bearings are determined accurately.

In any one of the above-mentioned embodiments, further, the step of determining the minimum distance value and the maximum distance value between the rotor and the magnetic bearing according to the distance value includes alternately sending a third electric signal and a fourth electric signal to the first magnetic bearing within a second preset duration; controlling, by the third electric signal, the first magnetic bearing to attract the rotor in a second direction where the first sensor is located until the rotor is in contact with the first magnetic bearing; controlling, by the fourth electric signal, the first magnetic bearing to attract the rotor in a direction opposite to the second direction until the rotor is in contact with the first magnetic bearing; determining a first maximum distance value and a first minimum distance value between the rotor and the first sensor within the second preset duration; obtaining a first absolute value of a difference of the first maximum distance value and the first minimum distance value; and determining a first protective air gap value of the first magnetic bearing according to the first absolute value.

In some embodiments, the third electric signal and the fourth electric signal are alternately sent to the first magnetic bearing within the second preset duration, and the third electric signal is configured to control the first magnetic bearing to attract the rotor in the second direction where the sensor is located until the rotor is in contact with the first magnetic bearing, at the moment, the first sensor can read the first minimum distance value between the rotor and the sensor, that is, the first minimum distance value between the rotor and the first magnetic bearing; and the fourth electric signal is configured to control the first magnetic bearing to attract the rotor in the direction opposite to the second direction until the rotor is in contact with the second magnetic bearing, at the moment, the first sensor can read the first maximum distance value between the rotor and the first sensor, that is, the first maximum distance value between the rotor and the first magnetic bearing. Then, the absolute value of the difference of the first maximum distance value and the first minimum distance value, that is, a first average moving air gap value of the rotor in the first magnetic bearing, is calculated; and when the calculated first average moving air gap value is less than or equal to the preset air gap value, that is, the calibrated moving air gap value, a product of the first average moving air gap value and the preset protection coefficient is calculated and is set as the final protective air gap value. If the first average moving air gap value, that is, the above-mentioned first absolute value, is greater than the preset air gap value, the product of the preset air gap value and the preset protection coefficient is used as the final protective air gap value.

In any one of the above-mentioned embodiments, further, the step of determining the minimum distance value and the maximum distance value between the rotor and the magnetic bearing according to the distance value further includes: sending a fifth electric signal to the second magnetic bearing while sending the third electric signal to the first magnetic bearing within the second preset duration; sending a sixth electric signal to the second magnetic bearing while sending the fourth electric signal to the first magnetic bearing; controlling, by the fifth electric signal, the second magnetic bearing to attract the rotor in a third direction where the second sensor is located until the rotor is in contact with the second magnetic bearing; controlling, by the sixth electric signal, the second magnetic bearing to attract the rotor in a direction opposite to the third direction until the rotor is in contact with the second magnetic bearing; determining a second maximum distance value and a second minimum distance value between the rotor and the second sensor within the second preset duration; obtaining a second absolute value of a difference of the second maximum distance value and the second minimum distance value; and determining a second protective air gap value of the second magnetic bearing according to the second absolute value; and the third direction is opposite to the second direction.

In some embodiments, within the second preset duration, the third electric signal is sent to the first magnetic bearing so that the first magnetic bearing attracts one end of the rotor in the second direction, and meanwhile, the fifth electric signal is sent to the second magnetic bearing so that the second magnetic bearing attracts the other end of the rotor in the third direction, that is, the direction opposite to the second direction, at the moment, the two ends of the rotor respectively move in the opposite directions, that is, the rotor is "inclined" within the range of the magnetic bearings at the two ends until the two ends of the rotor are respectively in contact with the first magnetic bearing and the second magnetic bearing; and then, the fourth electric signal is sent to the first magnetic bearing so that the first magnetic bearing attracts one end of the rotor in the direction opposite to the second direction, and meanwhile, the sixth electric signal is sent to the second magnetic bearing so that the second magnetic bearing attracts the other end of the rotor in the direction opposite to the third direction, at the moment, the rotor is "inclined" in the opposite directions within the range of the magnetic bearings at the two ends. The two ends of the rotor are controlled to be respectively close to the first magnetic bearing and second magnetic bearing in the opposite directions, so that the movement range of the rotor changes, at the moment, the actual moving air gap of the rotor can be acquired more accurately, and a first protective air gap of the rotor on the first magnetic bearing and a second protective air gap of the rotor on the second magnetic bearing can be respectively obtained by calculation.

In any one of the above-mentioned embodiments, further, the preset plane is a plane where the sensor is located and which is perpendicular to an axis of the magnetic bearing; and the preset protection coefficient is a natural number greater than 0 and less than 1.

In some embodiments, the preset plane is a plane where the sensor is located and which is perpendicular to an axis of the magnetic bearing. In one embodiment, the axis of the magnetic bearing may be set as a z axis, a straight line where the sensor is located and which is perpendicular to the axis of the magnetic bearing is set as a y axis, and a plane where the z axis and the y axis are located is the preset plane. Further, a value of the preset protection coefficient K is within the range: $0<K<1$.

Another embodiment of the present disclosure provides a computer-readable storage medium having stored therein a computer program that, when executed by a processor, causes to perform the protective air gap value setting method for a magnetic bearing compressor as described in any one of the above-mentioned embodiments. Therefore, the computer-readable storage medium has all the beneficial effects of the protective air gap value setting method for the magnetic bearing compressor in any one of the above-mentioned embodiments.

BRIEF DESCRIPTION OF THE DRAWINGS

Embodiments of the present disclosure will be apparent and easily understood in the description in conjunction with the following accompanying drawings, in which.

Figure 1:
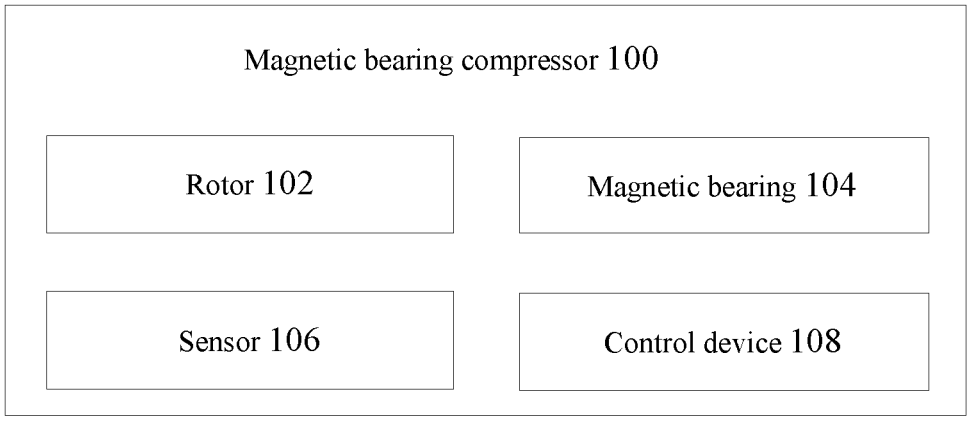
FIG. 1 shows a block diagram of a magnetic bearing compressor according to an embodiment of the present disclosure.

Reference numerals and member names in FIG. 7 to FIG. 13 are in a corresponding relationship:

front protective bearing 20, first probe 22, second probe 24, third probe 26, fourth probe 28, inner wall 30 of the front protective bearing, rear protective bearing 40, fifth probe 42, sixth probe 44, seventh probe 46, eighth probe 48, inner wall 50 of the rear protective bearing, rotor 102, and sensor 106.

DETAILED DESCRIPTION OF THE DISCLOSURE

In order to understand embodiments of the present disclosure more clearly, the present disclosure will be further described in detail below in conjunction with the accompanying drawings and specific implementations. It should be noted that the embodiments in the present disclosure and features in the embodiments can be combined with each other without conflicts.

Many concrete details are described in the following description to facilitate sufficiently understanding the present disclosure. However, the present disclosure can also be implemented in other manners different from the manner described herein, and therefore, the protective scope of the present disclosure is not limited by the following disclosed specific embodiments.

A magnetic bearing compressor, an air conditioner, a protective air gap value setting method for a magnetic bearing compressor, and a computer-readable storage medium according to some embodiments of the present disclosure will be described below with reference to FIG. 1 to FIG. 14.

As shown in FIG. 1, in an embodiment of the present disclosure, provided is a magnetic bearing compressor 100, including: a rotor 102, a magnetic bearing 104, a sensor 106, and a control device 108; the magnetic bearing 104 is sleeved on the rotor 102; the sensor 106 is arranged on the magnetic bearing 104 and is configured to detect a distance value between the rotor 102 and the sensor 106 on a preset plane; and the control device 108 is configured to receive the distance value and determine the minimum distance value and the maximum distance value between the rotor and the magnetic bearing according to the distance value, obtain an absolute value of a difference of the maximum distance value and the minimum distance value, and obtain a protective air gap value according to the absolute value and a preset protection coefficient when the absolute value is less than or equal to a preset air gap value.

In the embodiment, the magnetic bearing compressor includes the rotor, the magnetic bearing, the sensor, and the control device. The sensor detects the distance value between the rotor and the sensor on the preset plane and transmits the distance value to the control device. After receiving the value, detected by the sensor, of the distance, the control device determines the minimum distance value and the maximum distance value between the rotor and the magnetic bearing, and calculates the absolute value of the difference of the maximum distance value and the minimum distance value, that is, an average value of the distance. Further, the preset air gap value is acquired, the calculated absolute value is compared with the preset air gap value, and the protective air gap value is obtained according to the absolute value and the preset protection coefficient when the absolute value is less than the preset air gap value. By applying some embodiments provided by the present disclosure, an appropriate protective air gap can be more accurately obtained, the situation that the rotor comes into collision with the magnetic bearing during actual operation due to the fact that a designed moving air gap is directly used as the protective air gap can be avoided, the magnetic bearing and the rotor can be effectively protected in advance, the accuracy for bearing protection can be improved, the response time of bearing control protection under an extreme condition can be shortened, the wear degrees of the rotor and the magnetic bearing can be lowered, and then, the service life of a complete machine can be prolonged.

In one embodiment, the protective air gap is firstly calibrated before the magnetic bearing compressor leaves factory. Firstly, the rotor is controlled to move in the magnetic bearing, and the maximum value and the minimum value, detected by the sensor arranged on the magnetic bearing, of the distance between the rotor and the magnetic bearing are continuously acquired. The sensor can be arranged on the side of the magnetic bearing, and a sensor probe of the sensor is flush with the inner surface of the magnetic bearing, so that the distance between the rotor and the magnetic bearing is accurately acquired. The control device continuously records the value, acquired by the sensor, of the distance within a duration, and compares the maximum distance value and the minimum distance value in a recorded distance value set. Further, after the maximum distance value and the minimum distance value are determined, the absolute value of the difference of the maximum distance value and the minimum distance value, that is, an average moving air gap, is calculated; and when the calculated average moving air gap is less than or equal to the preset air gap value, that is, the calibrated moving air gap value, a product of the above-mentioned absolute value and the preset protection coefficient is further calculated and is set as the final protective air gap value.

In an embodiment of the present disclosure, further, the control device is further configured to set a product of the preset air gap value and the preset protection coefficient as the protective air gap value when the absolute value is greater than the preset air gap value.

In the embodiment, when the calculated absolute value is greater than the preset air gap value, it proves that the calibrated moving air gap is more conservative, at the moment, by taking a product of the calibrated moving air gap and the preset protection coefficient as the final protective air gap value, a protection action can be triggered more rapidly and timely, the response time of bearing control protection under an extreme condition can be shortened, the wear degrees of the rotor and the magnetic bearing can be lowered, and then, the service life of a complete machine can be prolonged.

In an embodiment of the present disclosure, further, the control device is further configured to: alternately send a first electric signal and a second electric signal to the magnetic bearing within a first preset duration; control, by the first electric signal, the magnetic bearing to attract the rotor in a first direction where the sensor is located until the rotor is in contact with the magnetic bearing; control, by the second electric signal, the magnetic bearing to attract the rotor in a direction opposite to the first direction until the rotor is in contact with the magnetic bearing; and acquire the distance value between the rotor and the sensor on the plane within the first preset duration and to determine the minimum distance value and the maximum distance value.

In the embodiment, the first electric signal and the second electric signal are alternately sent to the magnetic bearing within the first preset duration, and the first electric signal is configured to control the magnetic bearing to attract the rotor in the first direction where the sensor is located until the rotor is in contact with the magnetic bearing, at the moment, the sensor can read the minimum distance value between the rotor and the sensor, that is, the minimum distance value between the rotor and the magnetic bearing; and the second electric signal is configured to control the magnetic bearing to attract the rotor in the direction opposite to the first direction until the rotor is in contact with the magnetic bearing, at the moment, the sensor can read the maximum distance value between the rotor and the sensor, that is, the maximum distance value between the rotor and the magnetic bearing.

In an embodiment of the present disclosure, further, the magnetic bearing includes a first magnetic bearing and a second magnetic bearing, and the sensor includes a first sensor and a second sensor; and the first magnetic bearing is provided with the first sensor, and the second magnetic bearing is provided with the second sensor.

In the embodiment, the magnetic bearing compressor is provided with two magnetic bearings, that is, the first magnetic bearing and the second magnetic bearing, in total and to realize stable operation of the magnetic bearing compressor. Meanwhile, the first magnetic bearing is provided with the first sensor configured to acquire a distance between the rotor and the first magnetic bearing, and the second magnetic bearing is provided with the second sensor configured to acquire a distance between the rotor and the second magnetic bearing. Values of the distances between the rotor and each of the two magnetic bearings are acquired by the first sensor and the second sensor respectively, so that actual moving air gap values of the rotor in the corresponding magnetic bearings are determined accurately.

In an embodiment of the present disclosure, further, the control device is further configured to: alternately send a third electric signal and a fourth electric signal to the first magnetic bearing within a second preset duration; control, by the third electric signal, the first magnetic bearing to attract the rotor in a second direction where the first sensor is located until the rotor is in contact with the first magnetic bearing; control, by the fourth electric signal, the first magnetic bearing to attract the rotor in a direction opposite to the second direction until the rotor is in contact with the first magnetic bearing; determine a first maximum value and a first minimum distance value between the rotor and the first sensor within the second preset duration; obtain an absolute value of a difference of the first maximum distance value and the first minimum distance value; and determine a first protective air gap value of the first magnetic bearing according to the absolute value.

In the embodiment, the third electric signal and the fourth electric signal are alternately sent to the first magnetic bearing within the second preset duration, and the third electric signal is configured to control the first magnetic bearing to attract the rotor in the second direction where the sensor is located until the rotor is in contact with the first magnetic bearing, at the moment, the first sensor can read the first minimum distance value between the rotor and the sensor, that is, the first minimum distance value between the rotor and the first magnetic bearing; and the fourth electric signal is configured to control the first magnetic bearing to attract the rotor in the direction opposite to the second direction until the rotor is in contact with the second magnetic bearing, at the moment, the first sensor can read the first maximum distance value between the rotor and the first sensor, that is, the first maximum distance value between the rotor and the first magnetic bearing. Then, the absolute value of the difference of the first maximum distance value and the first minimum distance value, that is, a first average moving air gap value of the rotor in the first magnetic bearing, is calculated; and when the calculated first average moving air gap value is less than or equal to the preset air gap value, that is, the calibrated moving air gap value, a product of the first average moving air gap value and the preset protection coefficient is calculated and is set as the final protective air gap value. If the first average moving air gap value, that is, the above-mentioned first absolute value, is greater than the preset air gap value, the product of the preset air gap value and the preset protection coefficient is used as the final protective air gap value.

In an embodiment of the present disclosure, further, the control device is further configured to: send a fifth electric signal to the second magnetic bearing while sending the third electric signal to the first magnetic bearing within the second preset duration; send a sixth electric signal to the second magnetic bearing while sending the fourth electric signal to the first magnetic bearing; control, by the third electric signal, the second magnetic bearing to attract the rotor in a third direction where the second sensor is located until the rotor is in contact with the second magnetic bearing; control, by the fourth electric signal, the second magnetic bearing to attract the rotor in a direction opposite to the third direction until the rotor is in contact with the second magnetic bearing; determine a second maximum distance value and a second minimum distance value between the rotor and the second sensor within the second preset duration; obtain a second absolute value of a difference of the second maximum distance value and the second minimum distance value; and determine a second protective air gap value of the second magnetic bearing according to the second absolute value; and the third direction is opposite to the second direction.

In the embodiment, within the second preset duration, the third electric signal is sent to the first magnetic bearing so that the first magnetic bearing attracts one end of the rotor in the second direction, and meanwhile, the fifth electric signal is sent to the second magnetic bearing so that the second magnetic bearing attracts the other end of the rotor in the third direction, that is, the direction opposite to the second direction, at the moment, the two ends of the rotor respectively move in the opposite directions, that is, the rotor is "inclined" within the range of the magnetic bearings at the two ends until the two ends of the rotor are respectively in contact with the first magnetic bearing and the second magnetic bearing; and then, the fourth electric signal is sent to the first magnetic bearing so that the first magnetic bearing attracts one end of the rotor in the direction opposite to the second direction, and meanwhile, the sixth electric signal is sent to the second magnetic bearing so that the second magnetic bearing attracts the other end of the rotor in the direction opposite to the third direction, at the moment, the rotor is "inclined" in the opposite directions within the range of the magnetic bearings at the two ends. The two ends of the rotor are controlled to be respectively close to the first magnetic bearing and second magnetic bearing in the opposite directions, so that the movement range of the rotor changes, at the moment, the actual moving air gap of the rotor can be acquired more accurately, and a first protective air gap of the rotor on the first magnetic bearing and a second protective air gap of the rotor on the second magnetic bearing can be respectively obtained by calculation.

In an embodiment of the present disclosure, further, the preset plane is a plane where the sensor is located and which is perpendicular to an axis of the magnetic bearing; and the preset protection coefficient is a natural number greater than 0 and less than 1.

In the embodiment, the preset plane is a plane where the sensor is located and which is perpendicular to an axis of the magnetic bearing. In one embodiment, the axis of the magnetic bearing may be set as a z axis, a straight line where the sensor is located and which is perpendicular to the axis of the magnetic bearing is set as a y axis, and a plane where the z axis and the y axis are located is the preset plane. Further, a value of the preset protection coefficient K is within the range: $0<K<1$.

In an embodiment of the present disclosure, provided is an air conditioner including the magnetic bearing compressor in any one of the above-mentioned embodiments, and therefore, the air conditioner has all the beneficial effects of the magnetic bearing compressor in any one of the above-mentioned embodiments.

Figure 2:
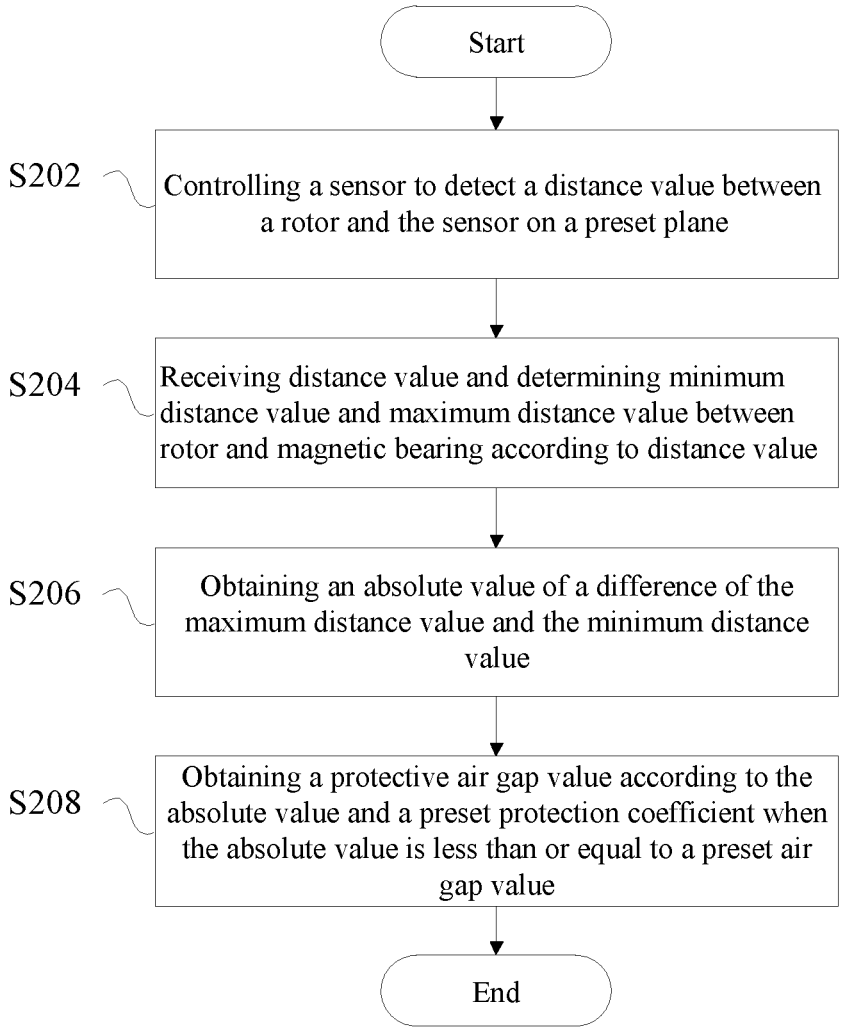
FIG. 2 shows a flow chart of a protective air gap value setting method for a magnetic bearing compressor according to an embodiment of the present disclosure.

As shown in FIG. 2, the embodiment of the present disclosure provides a protective air gap value setting method for a magnetic bearing compressor, which is used for the magnetic bearing compressor in any one of the above-mentioned embodiments. The protective air gap value setting method includes:

- S202, a sensor is controlled to detect a distance value between a rotor and the sensor on a preset plane;
- S204, the distance value is received, and the minimum distance value and the maximum distance value between the rotor and the magnetic bearing are determined according to the distance value;
- S206, an absolute value of a difference of the maximum distance value and the minimum distance value is obtained; and
- S208, a protective air gap value is obtained according to the absolute value and a preset protection coefficient when the absolute value is less than or equal to a preset air gap value.

In some embodiments, the magnetic bearing compressor includes a rotor, a magnetic bearing, a sensor, and a control device. The sensor detects the distance value between the rotor and the sensor on the preset plane and transmits the distance value to the control device. After receiving the value, detected by the sensor, of the distance, the control device determines the minimum distance value and the maximum distance value between the rotor and the magnetic bearing, and calculates the absolute value of the difference of the maximum distance value and the minimum distance value, that is, an average value of the distance. Further, the preset air gap value is acquired, the calculated absolute value is compared with the preset air gap value, and the protective air gap value is obtained according to the absolute value and the preset protection coefficient when the absolute value is less than the preset air gap value. By applying some embodiments provided by the present disclosure, an appropriate protective air gap can be more accurately obtained, the situation that the rotor comes into collision with the magnetic bearing during actual operation due to the fact that a designed moving air gap is directly used as the protective air gap can be avoided, the magnetic bearing and the rotor can be effectively protected in advance, the accuracy for bearing protection can be improved, the response time of bearing control protection under an extreme condition can be shortened, the wear degrees of the rotor and the magnetic bearing can be lowered, and then, the service life of a complete machine can be prolonged.

In one embodiment, the protective air gap is firstly calibrated before the magnetic bearing compressor leaves factory. Firstly, the rotor is controlled to move in the magnetic bearing, and the maximum value and the minimum value, detected by the sensor arranged on the magnetic bearing, of the distance between the rotor and the magnetic bearing are continuously acquired. The sensor can be arranged on the side of the magnetic bearing, and a sensor probe of the sensor is flush with the inner surface of the magnetic bearing, so that the distance between the rotor and the magnetic bearing is accurately acquired. The control device continuously records the value, acquired by the sensor, of the distance within a duration, and compares the maximum distance value and the minimum distance value in a recorded distance value set. Further, after the maximum distance value and the minimum distance value are determined, the absolute value of the difference of the maximum distance value and the minimum distance value, that is, an average moving air gap, is calculated; and when the calculated average moving air gap is less than or equal to the preset air gap value, that is, the calibrated moving air gap value, a product of the above-mentioned absolute value and the preset protection coefficient is further calculated and is set as the final protective air gap value.

Figure 3:
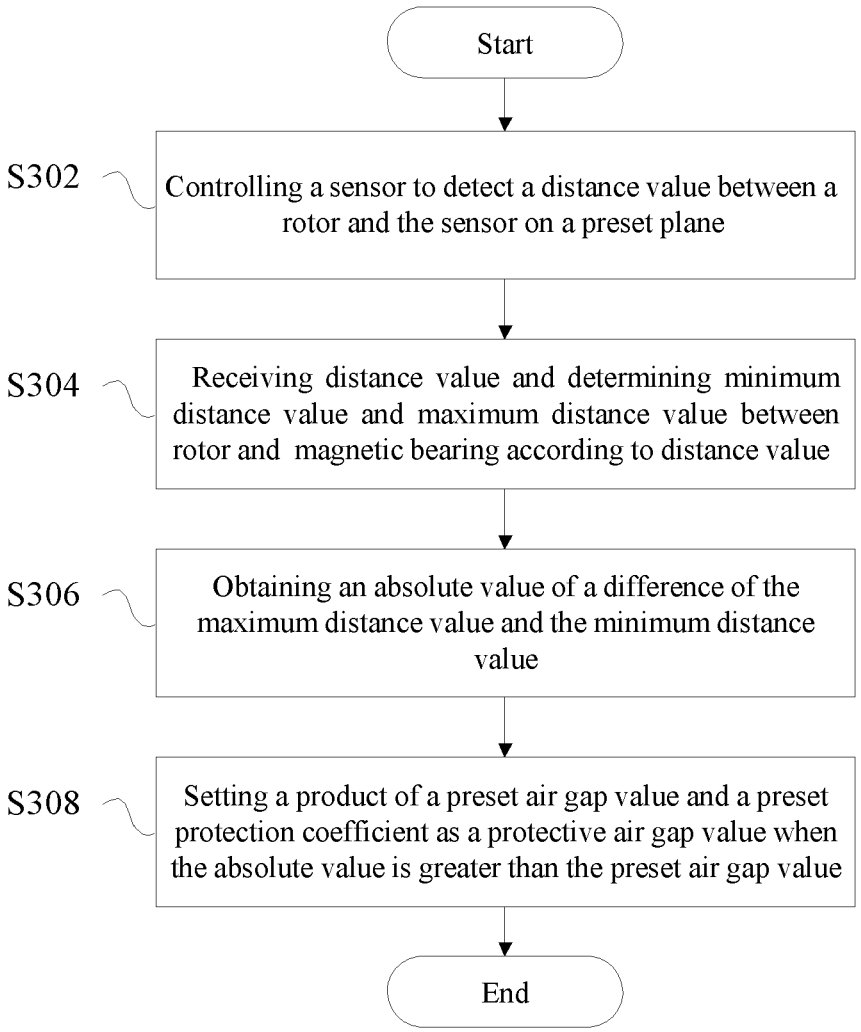
FIG. 3 shows a flow chart of a protective air gap value setting method for a magnetic bearing compressor according to another embodiment of the present disclosure.

In an embodiment of the present disclosure, further, as shown in FIG. 3, the protective air gap value setting method includes:

- S302, a sensor is controlled to detect a distance value between a rotor and the sensor on a preset plane;
- S304, the distance value is received, and the minimum distance value and the maximum distance value between the rotor and the magnetic bearing are determined according to the distance value;
- S306, an absolute value of a difference of the maximum distance value and the minimum distance value is obtained; and
- S308, a product of a preset air gap value and a preset protection coefficient is set as a protective air gap value when the absolute value is greater than the preset air gap value.

In the embodiment, when the calculated absolute value is greater than the preset air gap value, it proves that the calibrated moving air gap is more conservative, at the moment, by taking a product of the calibrated moving air gap and the preset protection coefficient as the final protective air gap value, a protection action can be triggered more rapidly and timely, the response time of bearing control protection under an extreme condition can be shortened, the wear degrees of the rotor and the magnetic bearing can be lowered, and then, the service life of a complete machine can be prolonged.

Figure 4:
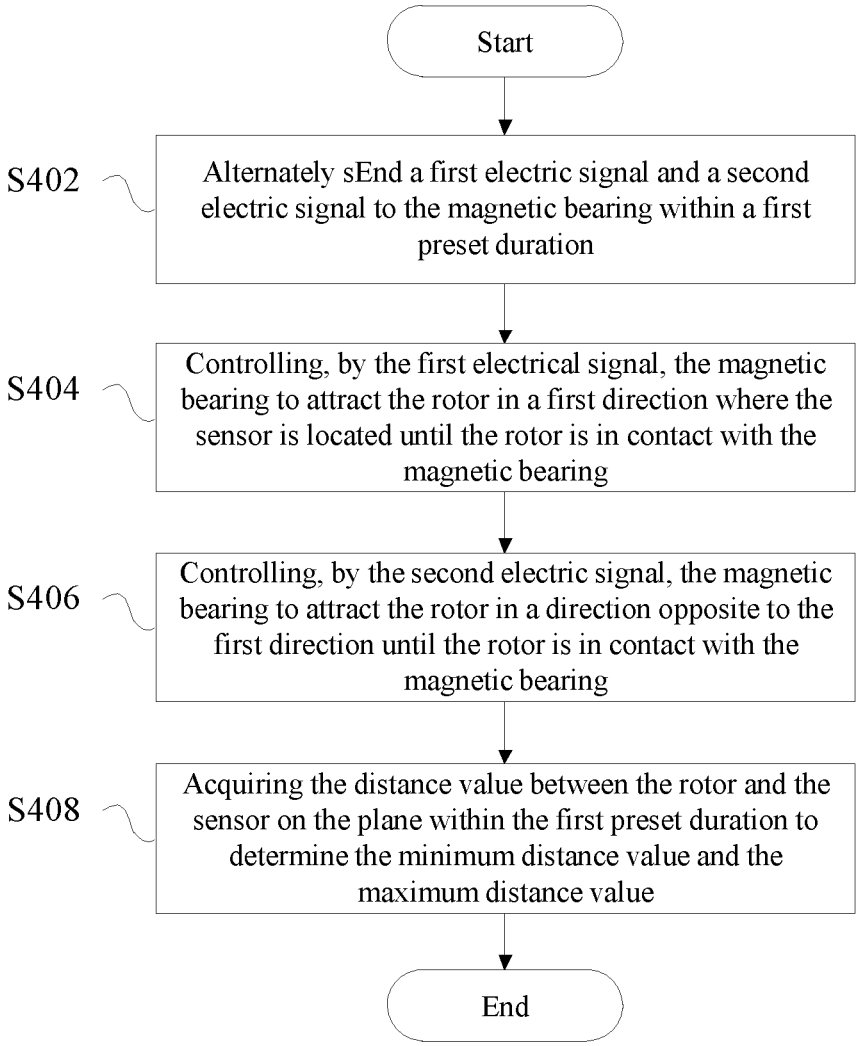
FIG. 4 shows a flow chart of a protective air gap value setting method for a magnetic bearing compressor according to a further embodiment of the present disclosure.

In an embodiment of the present disclosure, further, as shown in FIG. 4, the step that the minimum distance value and the maximum distance value between the rotor and the magnetic bearing are determined according to the distance value includes:

- S402, a first electric signal and a second electric signal are alternately sent to the magnetic bearing within a first preset duration;
- S404, the magnetic bearing is controlled by the first electric signal to attract the rotor in a first direction where the sensor is located until the rotor is in contact with the magnetic bearing;
- S406, the magnetic bearing is controlled by the second electric signal to attract the rotor in a direction opposite to the first direction until the rotor is in contact with the magnetic bearing; and
- S408, the distance value between the rotor and the sensor is acquired on the plane within the first preset duration and to determine the minimum distance value and the maximum distance value.

In the embodiment, the first electric signal and the second electric signal are alternately sent to the magnetic bearing within the first preset duration, and the first electric signal is configured to control the magnetic bearing to attract the rotor in the first direction where the sensor is located until the rotor is in contact with the magnetic bearing, at the moment, the sensor can read the minimum distance value between the rotor and the sensor, that is, the minimum distance value between the rotor and the magnetic bearing; and the second electric signal is configured to control the magnetic bearing to attract the rotor in the direction opposite to the first direction until the rotor is in contact with the magnetic bearing, at the moment, the sensor can read the maximum distance value between the rotor and the sensor, that is, the maximum distance value between the rotor and the magnetic bearing.

In an embodiment of the present disclosure, further, the magnetic bearing includes a first magnetic bearing and a second magnetic bearing, and the sensor includes a first sensor and a second sensor; and the first magnetic bearing is provided with the first sensor, and the second magnetic bearing is provided with the second sensor.

In the embodiment, the magnetic bearing compressor is provided with two magnetic bearings, that is, the first magnetic bearing and the second magnetic bearing, in total and to realize stable operation of the magnetic bearing compressor. Meanwhile, the first magnetic bearing is provided with the first sensor configured to acquire a distance between the rotor and the first magnetic bearing, and the second magnetic bearing is provided with the second sensor configured to acquire a distance between the rotor and the second magnetic bearing. Values of the distances between the rotor and each of the two magnetic bearings are acquired by the first sensor and the second sensor respectively, so that actual moving air gap values of the rotor in the corresponding magnetic bearings are determined accurately.

Figure 5:
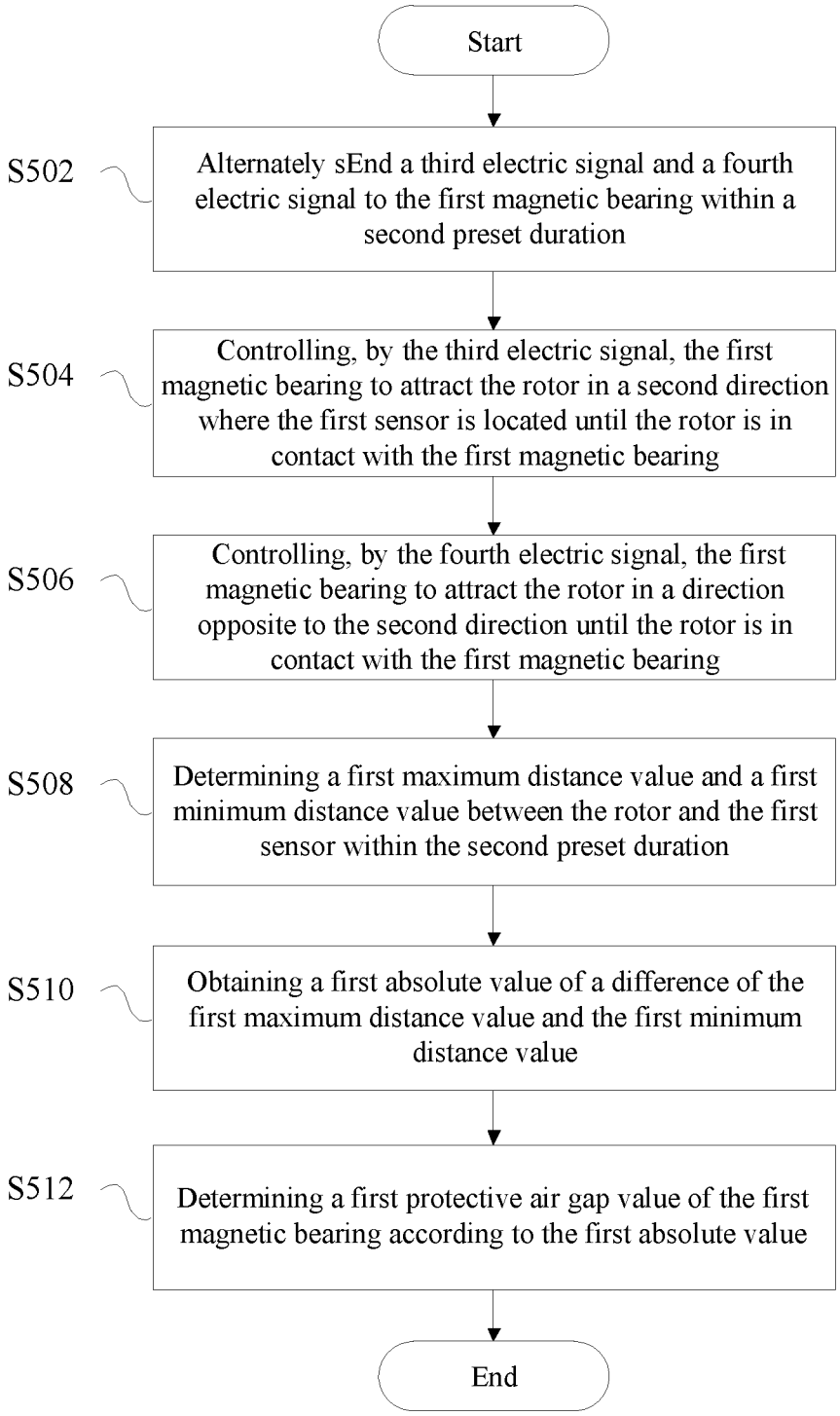
FIG. 5 shows a flow chart of a protective air gap value setting method for a magnetic bearing compressor according to a yet further embodiment of the present disclosure.

In an embodiment of the present disclosure, further, as shown in FIG. 5, the step that the minimum distance value and the maximum distance value between the rotor and the magnetic bearing are determined according to the distance value includes:

- S502, a third electric signal and a fourth electric signal are alternately sent to the first magnetic bearing within a second preset duration;
- S504, the first magnetic bearing is controlled by the third electric signal to attract the rotor in a second direction where the first sensor is located until the rotor is in contact with the first magnetic bearing;
- S506, the first magnetic bearing is controlled by the fourth electric signal to attract the rotor in a direction opposite to the second direction until the rotor is in contact with the first magnetic bearing;

S508, a first maximum distance value and a first minimum distance value between the rotor and the first sensor within the second preset duration are determined;

S510, a first absolute value of a difference of the first maximum distance value and the first minimum distance value is obtained; and S512, a first protective air gap value of the first magnetic bearing is determined according to the first absolute value.

In the embodiment, the third electric signal and the fourth electric signal are alternately sent to the first magnetic bearing within the second preset duration, and the third electric signal is configured to control the first magnetic bearing to attract the rotor in the second direction where the sensor is located until the rotor is in contact with the first magnetic bearing, at the moment, the first sensor can read the first minimum distance value between the rotor and the sensor, that is, the first minimum distance value between the rotor and the first magnetic bearing; and the fourth electric signal is configured to control the first magnetic bearing to attract the rotor in the direction opposite to the second direction until the rotor is in contact with the second magnetic bearing, at the moment, the first sensor can read the first maximum distance value between the rotor and the first sensor, that is, the first maximum distance value between the rotor and the first magnetic bearing. Then, the absolute value of the difference of the first maximum distance value and the first minimum distance value, that is, a first average moving air gap value of the rotor in the first magnetic bearing, is calculated; and when the calculated first average moving air gap value is less than or equal to the preset air gap value, that is, the calibrated moving air gap value, a product of the first average moving air gap value and the preset protection coefficient is calculated and is set as the final protective air gap value. If the first average moving air gap value, that is, the above-mentioned first absolute value, is greater than the preset air gap value, the product of the preset air gap value and the preset protection coefficient is used as the final protective air gap value.

Figure 6:
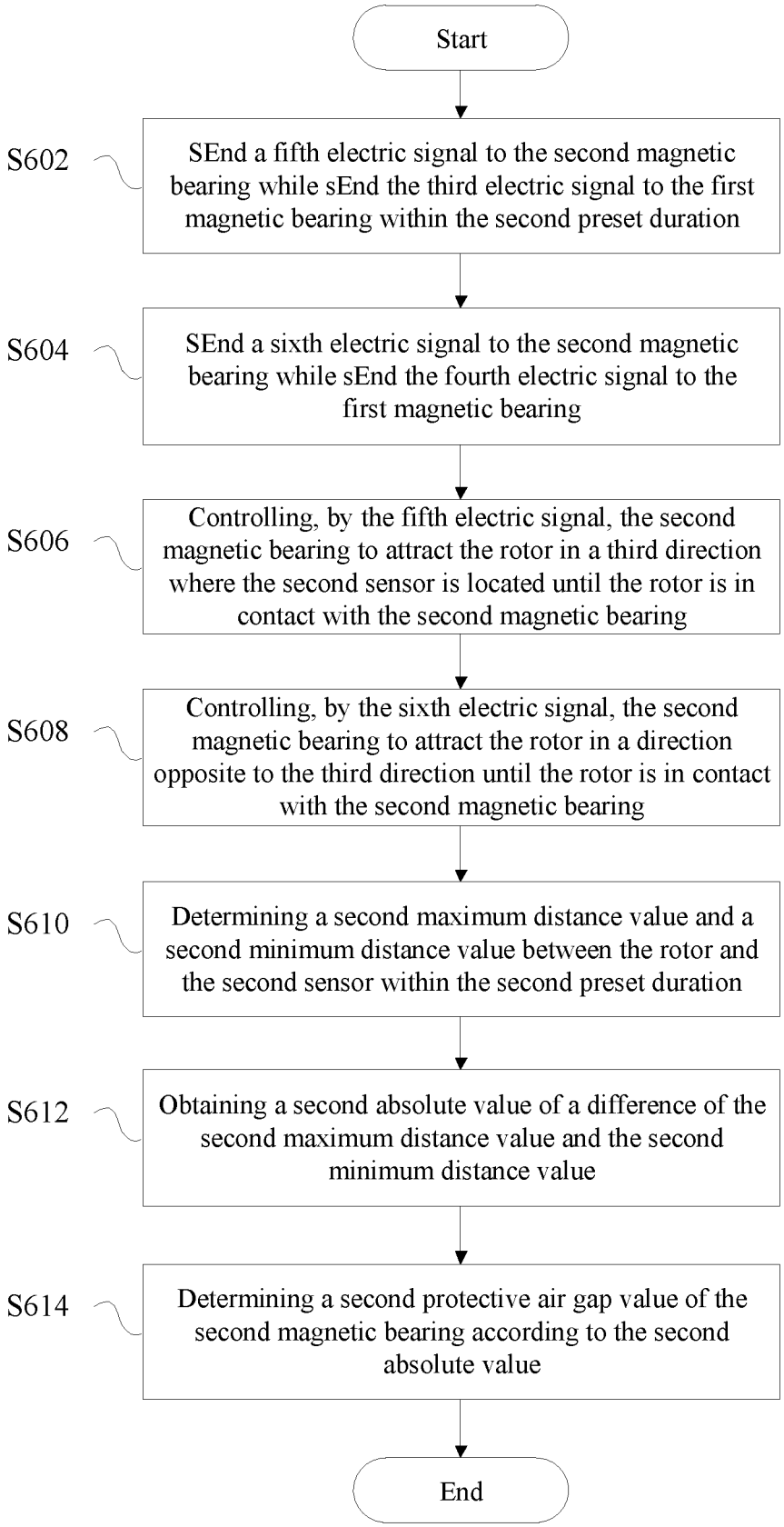
FIG. 6 shows a flow chart of a protective air gap value setting method for a magnetic bearing compressor according to further another embodiment of the present disclosure.

In an embodiment of the present disclosure, further, as shown in FIG. 6, the step that the minimum distance value and the maximum distance value between the rotor and the magnetic bearing are determined according to the distance value further includes:

S602, a fifth electric signal is sent to the second magnetic bearing while the third electric signal is sent to the first magnetic bearing within the second preset duration;

S604, a sixth electric signal is sent to the second magnetic bearing while the fourth electric signal is sent to the first magnetic bearing;

S606, the second magnetic bearing is controlled by the fifth electric signal to attract the rotor in a third direction where the second sensor is located until the rotor is in contact with the second magnetic bearing;

S608, the second magnetic bearing is controlled by the sixth electric signal to attract the rotor in a direction opposite to the third direction until the rotor is in contact with the second magnetic bearing;

S610, a second maximum distance value and a second minimum distance value between the rotor and the second sensor within the second preset duration are determined;

S612, a second absolute value of a difference of the second maximum distance value and the second minimum distance value is obtained; and S614, a second protective air gap value of the second magnetic bearing is determined according to the second absolute value, and the third direction is opposite to the second direction.

In the embodiment, within the second preset duration, the third electric signal is sent to the first magnetic bearing so that the first magnetic bearing attracts one end of the rotor in the second direction, and meanwhile, the fifth electric signal is sent to the second magnetic bearing so that the second magnetic bearing attracts the other end of the rotor in the third direction, that is, the direction opposite to the second direction, at the moment, the two ends of the rotor respectively move in the opposite directions, that is, the rotor is "inclined" within the range of the magnetic bearings at the two ends until the two ends of the rotor are respectively in contact with the first magnetic bearing and the second magnetic bearing; and then, the fourth electric signal is sent to the first magnetic bearing so that the first magnetic bearing attracts one end of the rotor in the direction opposite to the second direction, and meanwhile, the sixth electric signal is sent to the second magnetic bearing so that the second magnetic bearing attracts the other end of the rotor in the direction opposite to the third direction, at the moment, the rotor is "inclined" in the opposite directions within the range of the magnetic bearings at the two ends. The two ends of the rotor are controlled to be respectively close to the first magnetic bearing and second magnetic bearing in the opposite directions, so that the movement range of the rotor changes, at the moment, the actual moving air gap of the rotor can be acquired more accurately, and a first protective air gap of the rotor on the first magnetic bearing and a second protective air gap of the rotor on the second magnetic bearing can be respectively obtained by calculation.

In an embodiment of the present disclosure, further, the preset plane is a plane where the sensor is located and which is perpendicular to an axis of the magnetic bearing; and the preset protection coefficient is a natural number greater than 0 and less than 1.

In the embodiment, the preset plane is a plane where the sensor is located and which is perpendicular to an axis of the magnetic bearing. In one embodiment, the axis of the magnetic bearing may be set as a z axis, a straight line where the sensor is located and which is perpendicular to the axis of the magnetic bearing is set as a y axis, and a plane where the z axis and the y axis are located is the preset plane. Further, a value of the preset protection coefficient K is within the range: $0<K<1$.

Figure 7:
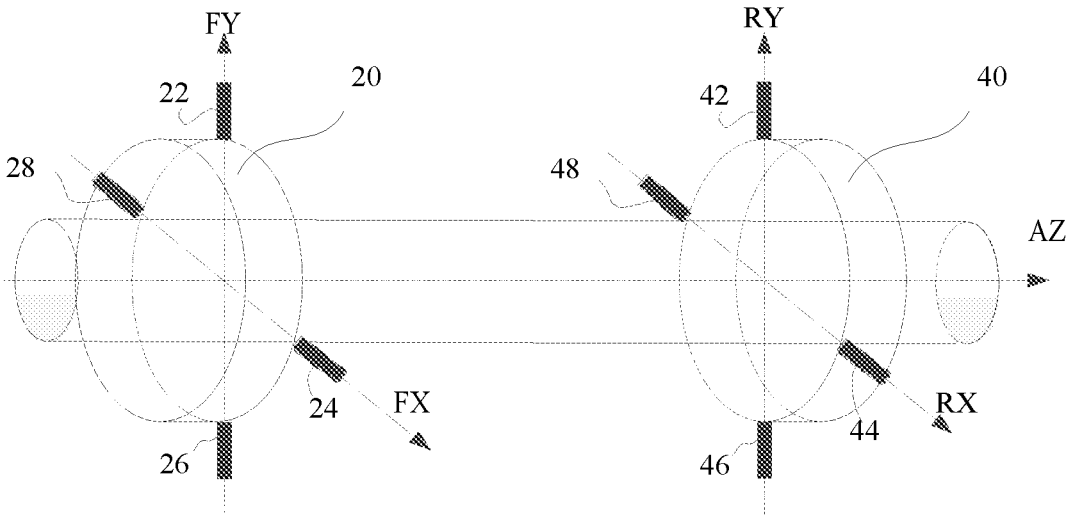
FIG. 7 shows a schematic diagram of an internal structure of a magnetic bearing compressor according to an embodiment of the present disclosure.

In a complete embodiment of the present disclosure, further, as shown in FIG. 7, the magnetic bearing compressor includes a front magnetic bearing, that is, the first magnetic bearing, and a rear magnetic bearing, that is, the second magnetic bearing, and the axis of the front magnetic bearing and the axis of the rear magnetic bearing coincide with each other. The front magnetic bearing is provided with a first sensor including four sensor probes which are respectively a first probe 22, a second probe 24, a third probe 26 and a fourth probe 28, and a connecting line of the first probe 22 and the third probe 26 and a connecting line of the second probe 24 and the fourth probe 28 are perpendicular to each other; and meanwhile, the rear magnetic bearing is provided with a second sensor including another four sensor probes which are in one-to-one correspondence to those of the first probe to the fourth probe in position and are respectively a fifth probe 42, a sixth probe 44, a seventh probe 46 and an eighth probe 48, and a connecting line of the fifth probe 42 and the seventh probe 46 and a connecting line of the sixth probe 44 and the eighth probe 48 are perpendicular to each other, shown in FIG. 7. Axes of the front magnetic bearing and the rear magnetic bearing are used as an AZ axis, and the axis of the front magnetic bearing, a FY axis serving as a straight line where the first probe 22 and the third probe 26 are located, a FX axis serving as a straight line where the second probe 24 and the fourth probe 28 are located, and the AZ axis form a F(XYZ) coordinate system, shown in FIG. 8; and a RY axis serving as a straight line where the fifth probe 42 and the seventh probe 46 are located, a RX axis serving as a straight line where the sixth probe 44 and the eighth probe 48 are located, and the AZ axis form a R(XYZ) coordinate system, shown in FIG. 7 to FIG. 9.

In some embodiments, the sensor can be respectively arranged as follows.

Embodiment 1: a front bearing displacement sensor is located in a positive direction of a front protective bearing 20 along the AZ axis, and a rear bearing displacement sensor is located in a positive direction of a rear protective bearing 40 along the AZ axis.

Embodiment 2: a front bearing displacement sensor is located in a negative direction of a front protective bearing 20 along the AZ axis, and a rear bearing displacement sensor is located in a negative direction of a rear protective bearing 40 along the AZ axis.

Embodiment 3: a front bearing displacement sensor is located in a negative direction of a front protective bearing 20 along the AZ axis, and a rear bearing displacement sensor is located in a positive direction of a rear protective bearing 40 along the AZ axis.

Figure 8:
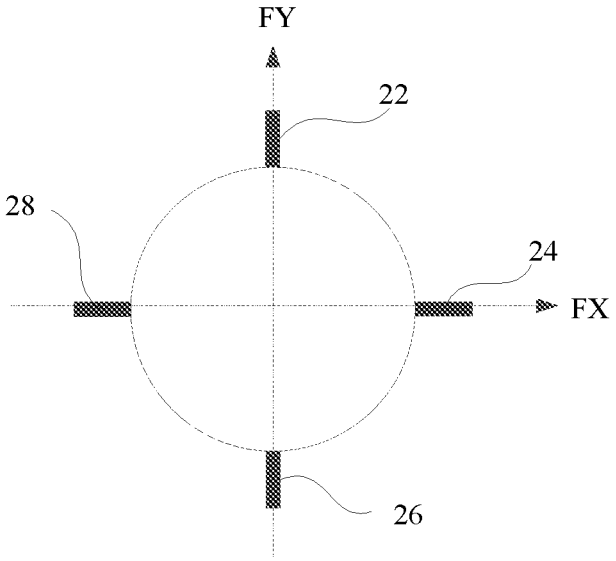
FIG. 8 shows a schematic diagram of positions of probes of sensors of a magnetic bearing compressor according to an embodiment of the present disclosure.
Figure 9:
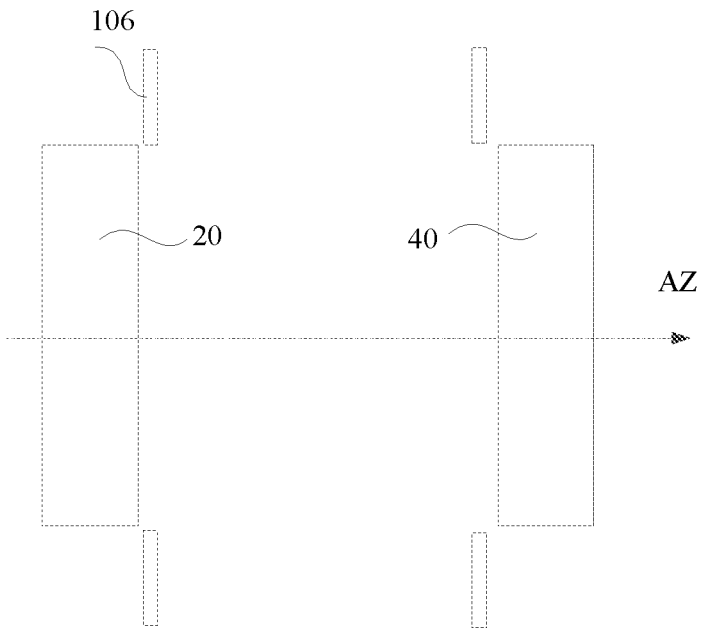
FIG. 9 shows a schematic diagram of positions of probes of sensors of a magnetic bearing compressor according to another embodiment of the present disclosure.

Embodiment 4: a front bearing displacement sensor is located in a positive direction of a front protective bearing 20 along the AZ axis, and a rear bearing displacement sensor is located in a negative direction of a rear protective bearing 40 along the AZ axis, that is, the embodiments as shown in FIG. 7 to FIG. 9.

Figure 10:
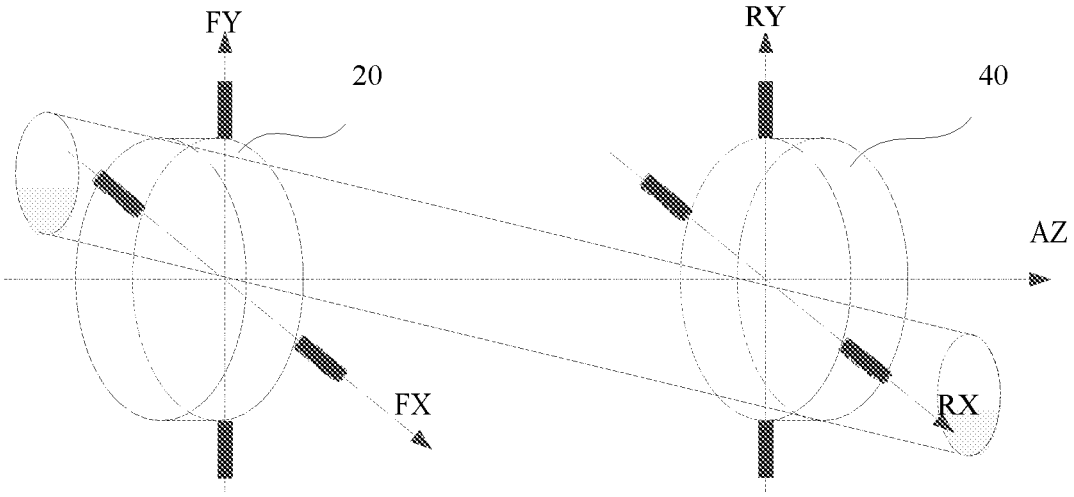
FIG. 10 shows a schematic diagram of a step that a protective air gap value is set for a magnetic bearing compressor according to an embodiment of the present disclosure.
Figure 11:
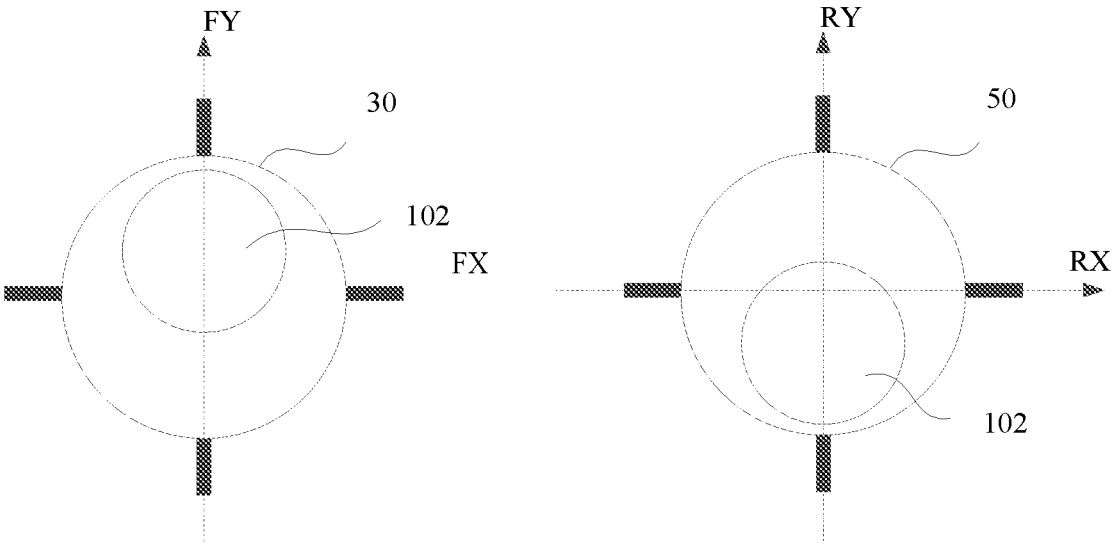
FIG. 11 shows a schematic diagram of a step that a protective air gap value is set for a magnetic bearing compressor according to another embodiment of the present disclosure.
Figure 12:
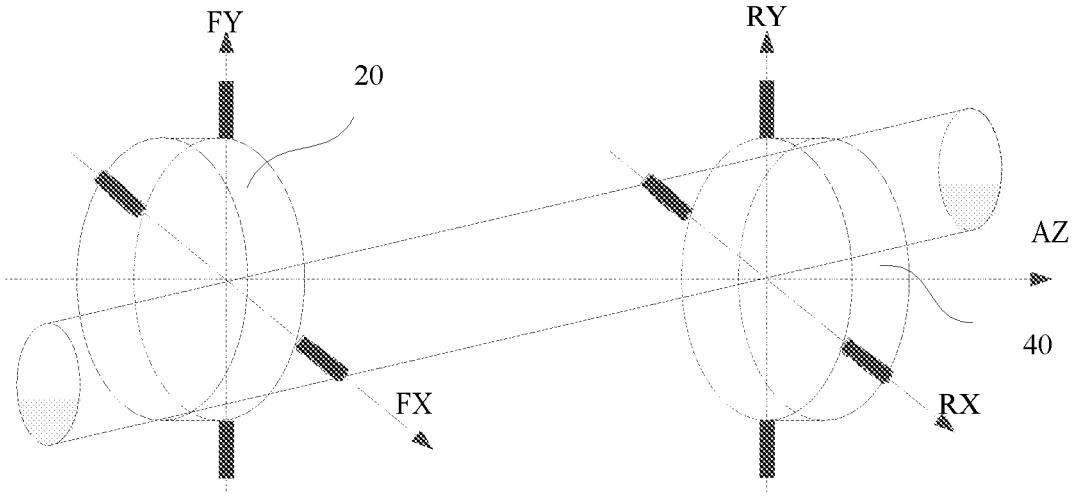
FIG. 12 shows a schematic diagram of a step that a protective air gap value is set for a magnetic bearing compressor according to further embodiment of the present disclosure.
Figure 13:
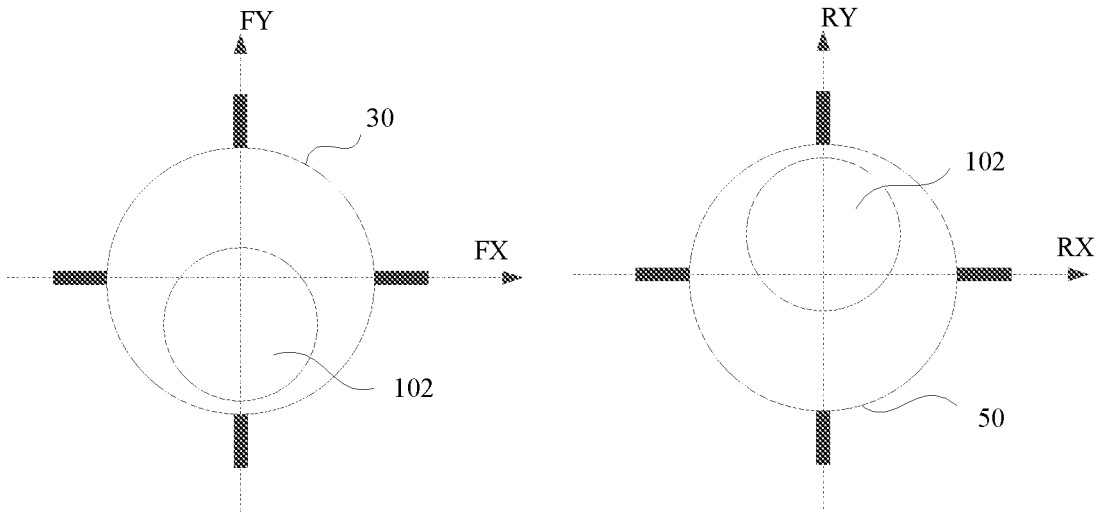
FIG. 13 shows a schematic diagram of a step that a protective air gap value is set for a magnetic bearing compressor according to yet further embodiment of the present disclosure.

The above-mentioned embodiment 4 is described below as an example, and sensors 106 are respectively close to an inner wall 50 of the front protective bearing and an inner wall 60 of the rear protective bearing, and steps of the process that the protective air gap is determined are described as follows:

(1) the front magnetic bearing is controlled to be electrified so that one end of the rotor 102 moves in the positive direction of the FY axis until a distance between one end of the rotor 102 and the first probe 22 is shortest, meanwhile, the rear magnetic bearing is controlled to be electrified so that one end of the rotor 102 moves in a direction opposite to the RY axis until a distance between one end of the rotor 102 and the seventh probe 46 is shortest, as shown in FIG. 10 and FIG. 11, and displacement values a1 and b1 of the rotor 102 on the FY axis and the RY axis at the moment are recorded, and a1 represents a minimum value of a distance between one end of the rotor 102 and the first magnetic bearing, and b1 represents a minimum value of a distance between one end of the rotor 102 and the second magnetic bearing;

(2) a control current of the front magnetic bearing is changed so that one end of the rotor 102 moves in a direction opposite to the FY axis until a distance between one end of the rotor 102 and the first probe 22 is longest and a distance between one end of the rotor 102 and the third probe 26 is shortest; and meanwhile, a control current of the rear magnetic bearing is changed so that the other end of the rotor 102 moves in the positive direction of the RY axis until a distance between one end of the rotor 102 and the seventh probe 46 is longest and a distance between one end of the rotor 102 and the fifth probe 42 is shortest, as shown in FIG. 12 and FIG. 13, and displacement values a1 and b2 of the rotor 102 on the FY axis and the RY axis at the moment are recorded, and a2 represents a maximum distance value between one end of the rotor 102 and the first magnetic bearing, and b2 represents a maximum value of a distance between the other end of the rotor 102 and the second magnetic bearing;

(3) a moving air gap value PFY of the rotor 102 on the FY axis is calculated according to a formula: PFY=abs(a2−a1); and a moving air gap value PRY of the rotor 102 on the RY axis is calculated according to a formula: PRY=abs(b2−b1);

(4) the control current of the front magnetic bearing and the control current of the rear magnetic bearing are changed again, so that a distance between one end of the rotor 102 and the second probe 24 is shortest under the attraction of the front magnetic bearing, meanwhile, a distance between the other end of the rotor 102 and the eighth probe 48 is shortest under the attraction of the rear magnetic bearing, and displacement values a3 and b3 of the rotor 102 on the FX axis and the RX axis at the moment are recorded;

(5) the control current of the front magnetic bearing and the control current of the rear magnetic bearing are changed again, so that a distance between one end of the rotor 102 and the fourth probe 28 is shortest under the attraction of the front magnetic bearing, meanwhile, a distance between the other end of the rotor 102 and the sixth probe 44 is shortest under the attraction of the rear magnetic bearing, and displacement values a4 and b4 of the rotor 102 on the FX axis and the RX axis at the moment are recorded; and (6) a moving air gap value PFX of the rotor 102 on the FX axis is calculated according to a formula: PFX=abs(a4−a3); and a moving air gap value PRX of the rotor 102 on the RX axis is calculated according to a formula: PRX=abs(b4−b3).

After the protective air gap values PFX, PFY, PRX and PRY of the rotor 102 in the directions of the FX axis, the FY axis, the RX axis, and the RY axis of the front magnetic bearing and the rear magnetic bearing are detected and calculated respectively, protective air gap values are calculated as follows:

① the protective air gap values are compared with a given protective air gap value, that is, a design value, and the smaller values which are obtained by comparison are regarded as degree-of-freedom air gaps of the rotor 102 in the directions of the FX axis, the FY axis, the RX axis, and the RY axis; and ② four degree-of-freedom air gaps, such as PFX, PFY, PRX and PRY which are obtained by comparison, are respectively multiplied by a preset protection coefficient K ($0<K<1$), and finally, protective air gap values of the rotor 102 in the fourth directions in total of the front magnetic bearing and the rear magnetic bearing are obtained by calculation.

Figure 14:
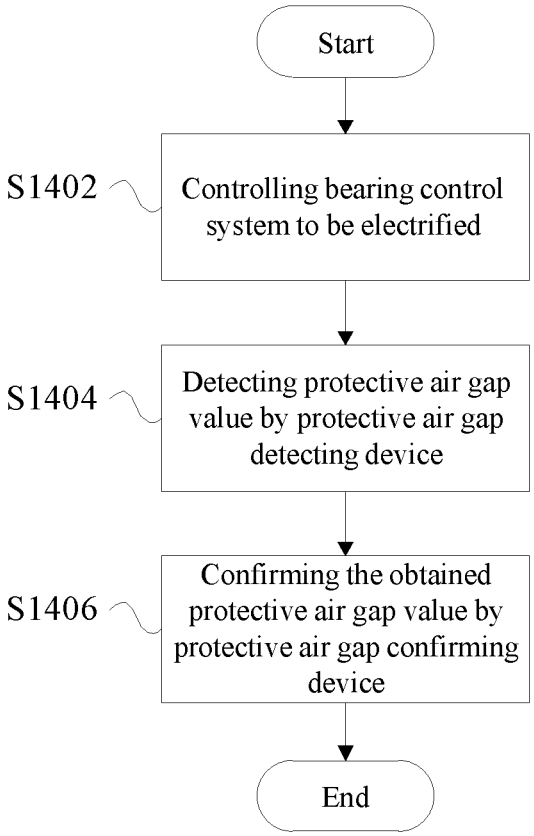
FIG. 14 shows a flow chart of a step that a protective air gap is set for a magnetic bearing compressor according to an embodiment of the present disclosure.

As shown in FIG. 14, a process that a protective air gap is set for a magnetic bearing compressor is described as follows.

S1402 Controlling a bearing control system to be electrified.

S1404 Detecting protective air gap value by protective air gap detection device.

S1406 Confirming the obtained protective air gap value by protective air gap confirming device.

In an embodiment of the present disclosure, provided is a computer-readable storage medium having stored therein a computer program that, when executed by a processor, causes to perform the protective air gap value setting method for a magnetic bearing compressor as described in any one of the above-mentioned embodiments. Therefore, the computer-readable storage medium has all the beneficial effects of the protective air gap value setting method for the magnetic bearing compressor in any one of the above-mentioned embodiments.

In the descriptions of the present disclosure, the term "a plurality of" refers to two or more. Unless otherwise defined, directional or positional relationships indicated by terms such as "cupper" and "lower" are directional or positional relationships based on the accompanying drawings, are merely intended to facilitate describing the present disclosure and simplifying the descriptions, rather than to indicate or imply that the appointed apparatus or element has to be located in a specific direction or structured and operated in the specific direction and not to be understood as restrictions on the present disclosure. Terms such as "connection", "installation" and "fixation" should be broadly understood. For example, "connection" may be fixed connection or detachable connection or integral connection, and may also be direct connection or indirect connection through an intermediate medium.

In the descriptions of the present disclosure, the descriptions of terms such as "an embodiment", "some embodiments" and "specific embodiments" mean that specific features, structures, materials or characteristics described in conjunction with the embodiment or example are included in at least one embodiment or example of the present disclosure. In the present disclosure, schematic representation for the above-mentioned terms does not necessarily refer to the same embodiment or example. Moreover, the described specific features, structures, materials or characteristics can be combined in any one or more embodiments or examples in an appropriate manner.

What is claimed is:

1. A magnetic bearing compressor, comprising:

a rotor;

a magnetic bearing, sleeved on the rotor;

a sensor, arranged on the magnetic bearing and configured to detect a distance value between the rotor and the sensor on a preset plane; and a control device, configured to:

receive the distance value and determine a minimum distance value and a maximum distance value between the rotor and the magnetic bearing according to the distance value;

obtain an absolute value of a difference between the maximum distance value and the minimum distance value; and obtain a protective air gap value according to the absolute value and a preset protection coefficient when the absolute value is less than or equal to a preset air gap value.

2. The magnetic bearing compressor of claim 1, wherein the control device is further configured to:

set a product of the preset air gap value and the preset protection coefficient as the protective air gap value when the absolute value is greater than the preset air gap value.

3. The magnetic bearing compressor of claim 2, wherein the control device is further configured to:

alternately send a first electric signal and a second electric signal to the magnetic bearing within a first preset duration;

control, by the first electric signal, the magnetic bearing to attract the rotor in a first direction where the sensor is located until the rotor is in contact with the magnetic bearing;

control, by the second electric signal, the magnetic bearing to attract the rotor in a direction opposite to the first direction until the rotor is in contact with the magnetic bearing; and acquire the distance value between the rotor and the sensor on the preset plane within the first preset duration to determine the minimum distance value and the maximum distance value.

4. The magnetic bearing compressor of claim 2, wherein the magnetic bearing comprises a first magnetic bearing and a second magnetic bearing, and the sensor comprises a first sensor and a second sensor;

wherein the first magnetic bearing is provided with the first sensor, and the second magnetic bearing is provided with the second sensor.

5. The magnetic bearing compressor of claim 4, wherein the control device is further configured to:

alternately send a third electric signal and a fourth electric signal to the first magnetic bearing within a second preset duration;

control, by the third electric signal, the first magnetic bearing to attract the rotor in a second direction where the first sensor is located until the rotor is in contact with the first magnetic bearing;

control, by the fourth electric signal, the first magnetic bearing to attract the rotor in a direction opposite to the second direction until the rotor is in contact with the first magnetic bearing;

determine a first maximum distance value and a first minimum distance value between the rotor and the first sensor within the second preset duration;

obtain a first absolute value of a difference of the first maximum distance value and the first minimum distance value; and determine a first protective air gap value of the first magnetic bearing according to the first absolute value.

6. The magnetic bearing compressor of claim 5, wherein the control device is further configured to:

send a fifth electric signal to the second magnetic bearing while sending the third electric signal to the first magnetic bearing within the second preset duration;

send a sixth electric signal to the second magnetic bearing while sending the fourth electric signal to the first magnetic bearing;

control, by the fifth electric signal, the second magnetic bearing to attract the rotor in a third direction where the second sensor is located until the rotor is in contact with the second magnetic bearing;

control, by the sixth electric signal, the second magnetic bearing to attract the rotor in a direction opposite to the third direction until the rotor is in contact with the second magnetic bearing;

determine a second maximum distance value and a second minimum distance value between the rotor and the second sensor within the second preset duration;

obtain a second absolute value of a difference of the second maximum distance value and the second minimum distance value; and determine a second protective air gap value of the second magnetic bearing according to the second absolute value;

wherein the third direction is opposite to the second direction.

7. The magnetic bearing compressor of claim 1, wherein the preset plane is a plane where the sensor is located and which is perpendicular to an axis of the magnetic bearing; and the preset protection coefficient is a natural number greater than 0 and less than 1.

8. An air conditioner, comprising the magnetic bearing compressor of claim 1.

9. A protective air gap value setting method, for the magnetic bearing compressor of claim 1, comprising:

controlling a sensor to detect a distance value between a rotor and the sensor on a preset plane;

receiving the distance value and determining a minimum distance value and a maximum distance value between the rotor and the magnetic bearing according to the distance value;

obtaining an absolute value of a difference of the maximum distance value and the minimum distance value; and obtaining a protective air gap value according to the absolute value and a preset protection coefficient when the absolute value is less than or equal to a preset air gap value.

10. The protective air gap value setting method of claim 9, further comprising:

setting a product of the preset air gap value and the preset protection coefficient as the protective air gap value when the absolute value is greater than the preset air gap value.

11. The protective air gap value setting method of claim 10, wherein determining a minimum distance value and a maximum distance value between the rotor and the magnetic bearing according to the distance value comprises:

alternately sending a first electric signal and a second electric signal to the magnetic bearing within a first preset duration;

controlling, by the first electric signal, the magnetic bearing to attract the rotor in a first direction where the sensor is located until the rotor is in contact with the magnetic bearing;

controlling, by the second electric signal, the magnetic bearing to attract the rotor in a direction opposite to the first direction until the rotor is in contact with the magnetic bearing; and acquiring the distance value between the rotor and the sensor on the preset plane within the first preset duration to determine the minimum distance value and the maximum distance value.

12. The protective air gap value setting method of claim 10, wherein the magnetic bearing comprises a first magnetic bearing and a second magnetic bearing, and the sensor comprises a first sensor and a second sensor;

wherein the first magnetic bearing is provided with the first sensor, and the second magnetic bearing is provided with the second sensor.

13. The protective air gap value setting method of claim 12, wherein determining a minimum distance value and a maximum distance value between the rotor and the magnetic bearing according to the distance value comprises:

alternately sending a third electric signal and a fourth electric signal to the first magnetic bearing within a second preset duration;

controlling, by the third electric signal, the first magnetic bearing to attract the rotor in a second direction where the first sensor is located until the rotor is in contact with the first magnetic bearing;

controlling, by the fourth electric signal, the first magnetic bearing to attract the rotor in a direction opposite to the second direction until the rotor is in contact with the first magnetic bearing;

determining a first maximum distance value and a first minimum distance value between the rotor and the first sensor within the second preset duration;

obtaining a first absolute value of a difference of the first maximum distance value and the first minimum distance value; and determining a first protective air gap value of the first magnetic bearing according to the first absolute value.

14. The protective air gap value setting method of claim 13, wherein determining a minimum distance value and a maximum distance value between the rotor and the magnetic bearing according to the distance value further comprises:

sending a fifth electric signal to the second magnetic bearing while sending the third electric signal to the first magnetic bearing within the second preset duration;

sending a sixth electric signal to the second magnetic bearing while sending the fourth electric signal to the first magnetic bearing;

controlling, by the fifth electric signal, the second magnetic bearing to attract the rotor in a third direction where the second sensor is located until the rotor is in contact with the second magnetic bearing;

controlling, by the sixth electric signal, the second magnetic bearing to attract the rotor in a direction opposite to the third direction until the rotor is in contact with the second magnetic bearing;

determining a second maximum distance value and a second minimum distance value between the rotor and the second sensor within the second preset duration;

obtaining a second absolute value of a difference of the second maximum distance value and the second minimum distance value; and determining a second protective air gap value of the second magnetic bearing according to the second absolute value;

wherein the third direction is opposite to the second direction.

15. The protective air gap value setting method of claim 9, wherein the preset plane is a plane where the sensor is located and which is perpendicular to an axis of the magnetic bearing; and the preset protection coefficient is a natural number greater than 0 and less than 1.

16. A computer-readable storage medium having stored therein a computer program that, when executed by a processor, causes to perform a protective air gap value setting method of claim 9.

* * * * *